US011814850B2

(12) United States Patent
Boo

(10) Patent No.: US 11,814,850 B2
(45) **Date of Patent: *Nov. 14, 2023**

(54) SET OF PANELS

(71) Applicant: Välinge Innovation AB, Viken (SE)

(72) Inventor: Christian Boo, Kagerod (SE)

(73) Assignee: Välinge Innovation AB, Viken (SE)

( * ) Notice: Subject to any disclaimer, the term of this patent is extended or adjusted under 35 U.S.C. 154(b) by 397 days.

This patent is subject to a terminal disclaimer.

(21) Appl. No.: 17/076,445

(22) Filed: Oct. 21, 2020

(65) Prior Publication Data

US 2021/0207385 A1 Jul. 8, 2021

Related U.S. Application Data

(63) Continuation of application No. 16/366,173, filed on Mar. 27, 2019, now Pat. No. 10,851,549, which is a (Continued)

(30) Foreign Application Priority Data

Sep. 30, 2016 (SE) ..... 1651290-7

(51) Int. Cl.
*E04F 15/02* (2006.01)
*E04F 15/10* (2006.01)

(52) U.S. Cl.
CPC .. *E04F 15/02038* (2013.01); *E04F 15/02033* (2013.01); *E04F 15/105* (2013.01); (Continued)

(58) Field of Classification Search
CPC ..... E04F 15/02038; E04F 15/02033; E04F 15/105; E04F 2201/0146; E04F 2201/04; E04F 2201/042; E04F 2201/02
See application file for complete search history.

(56) References Cited

U.S. PATENT DOCUMENTS 1,787,027 A 12/1930 Wasleff
3,120,083 A 2/1964 Dahlberg et al.
(Continued)

FOREIGN PATENT DOCUMENTS

DE 2 251 762 5/1974
DE 202 07 844 U 8/2002
(Continued)

OTHER PUBLICATIONS

U.S. Appl. No. 16/713,431, Mats Nilsson and Per Nygren, filed Dec. 13, 2019, (Cited herein as US Patent Application Publication No. 2020/0362567 A1 of Nov. 19, 2020).
(Continued)

*Primary Examiner* — Adriana Figueroa
(74) *Attorney, Agent, or Firm* — Boone IP Law

(57) ABSTRACT

A set of panels including a first panel and a second panel. A first edge of the first panel and a second edge of the second are configured to be locked together and assembled by a vertical displacement of the second edge relative the first edge. The first edge includes a locking element configured to cooperate with a locking groove at the second edge for locking in a horizontal and in the vertical direction. The first edge includes a tongue configured to cooperate with a tongue groove at the second edge for locking in a vertical direction. An upper part of the first edge includes a first guiding surface and a lower edge of the lower lip includes a second guiding surface. An upper part of the locking element includes a third guiding surface and a lower edge of the locking groove includes a fourth guiding surface.

16 Claims, 8 Drawing Sheets

Related U.S. Application Data continuation of application No. 15/404,617, filed on Jan. 12, 2017, now Pat. No. 10,287,777.

(52) U.S. Cl.
CPC ... *E04F 2201/0146* (2013.01); *E04F 2201/04* (2013.01); *E04F 2201/042* (2013.01)

(56) References Cited

U.S. PATENT DOCUMENTS 3,247,638 A 4/1966 Gay et al.
3,538,665 A 11/1970 Gohner
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,919,820 A 11/1975 Green
4,113,399 A 9/1978 Hansen, Sr. et al.
4,172,169 A 10/1979 Mawson et al.
4,176,210 A 11/1979 Skinner
4,180,615 A 12/1979 Bettoli
4,187,131 A 2/1980 Shortway et al.
4,196,554 A 4/1980 Anderson et al.
4,313,866 A 2/1982 Renshaw
4,333,987 A 6/1982 Kwart et al.
4,393,187 A 7/1983 Boba et al.
4,423,178 A 12/1983 Renshaw
4,426,820 A 1/1984 Terbrack et al.
4,489,115 A 12/1984 Layman et al.
4,507,188 A 3/1985 Chu
4,512,131 A 4/1985 Laramore
4,599,841 A 7/1986 Haid
4,614,680 A 9/1986 Fry et al.
4,772,500 A 9/1988 Stroppiana
4,785,065 A 11/1988 Uhl et al.
4,807,412 A 2/1989 Frederiksen
5,007,222 A 4/1991 Raymond
5,112,671 A 5/1992 Diamond et al.
5,148,850 A 9/1992 Urbanick
5,162,141 A 11/1992 Davey et al.
5,182,892 A 2/1993 Chase
5,344,700 A 9/1994 McGath et al.
5,380,794 A 1/1995 Schaefer et al.
5,441,677 A 8/1995 Phillips, Sr.
5,458,953 A 10/1995 Wang et al.
5,465,546 A 11/1995 Buse
5,548,937 A 8/1996 Shimonohara
5,618,602 A 4/1997 Nelson
5,630,304 A 5/1997 Austin
5,670,237 A 9/1997 Shultz et al.
5,694,730 A 12/1997 Del Rincon et al.
5,797,237 A 8/1998 Finkell, Jr.
5,950,389 A 9/1999 Porter
6,006,486 A 12/1999 Moriau et al.
6,052,960 A 4/2000 Yonemura
6,065,262 A 5/2000 Motta
6,101,778 A 8/2000 Martensson
6,139,945 A 10/2000 Krejchi et al.
6,173,548 B1 1/2001 Hamar et al.
6,182,410 B1 2/2001 Pervan
6,209,278 B1 4/2001 Tychsen
6,216,409 B1 4/2001 Roy et al.
6,233,899 B1 5/2001 Mellert et al.
6,291,078 B1 9/2001 Chen et al.
6,324,809 B1 12/2001 Nelson
6,332,733 B1 12/2001 Hamberger et al.
6,345,481 B1 2/2002 Nelson
6,363,677 B1 4/2002 Chen
6,455,127 B1 9/2002 Valtanen
6,490,836 B1 12/2002 Moriau et al.
6,505,452 B1 1/2003 Hannig
6,536,178 B1 3/2003 Palsson et al.
6,546,691 B2 4/2003 Leopolder
6,553,724 B1 4/2003 Bigler
6,558,070 B1 5/2003 Valtanen
6,617,009 B1 9/2003 Chen et al.
6,647,690 B1 11/2003 Martensson
6,672,030 B2 1/2004 Schulte
6,675,545 B2 1/2004 Chen et al.
6,729,091 B1 5/2004 Martensson
6,761,008 B2 7/2004 Chen et al.
6,763,643 B1 7/2004 Martensson
6,766,622 B1 7/2004 Theirs
6,769,218 B2 8/2004 Pervan
6,769,219 B2 8/2004 Schwitte et al.
6,772,568 B2 8/2004 Thiers
6,790,512 B2 9/2004 MacQueen et al.
6,804,926 B1 10/2004 Eisermann
6,851,241 B2 2/2005 Pervan
6,854,235 B2 2/2005 Martensson
6,862,857 B2 3/2005 Tychsen
6,865,855 B2 3/2005 Knauseder
6,874,292 B2 4/2005 Moriau
6,880,307 B2 4/2005 Schwitte
6,895,881 B1 5/2005 Whitaker
6,928,779 B2 8/2005 Moriau et al.
6,986,934 B2 1/2006 Chen et al.
7,051,486 B2 5/2006 Pervan
7,090,430 B1 8/2006 Fletcher
7,121,058 B2 10/2006 Palsson et al.
7,155,871 B1 1/2007 Stone et al.
7,169,460 B1 1/2007 Chen et al.
7,171,791 B2 2/2007 Pervan
7,211,310 B2 5/2007 Chen et al.
7,251,916 B2 8/2007 Konzelmann et al.
7,275,350 B2 10/2007 Pervan et al.
7,337,588 B1 3/2008 Moebus
7,377,081 B2 5/2008 Ruhdorfer
7,398,625 B2 7/2008 Pervan
7,419,717 B2 9/2008 Chen et al.
7,451,578 B2 11/2008 Hannig
7,454,875 B2 11/2008 Pervan et al.
7,484,337 B2 2/2009 Hecht
7,552,568 B2 6/2009 Palsson et al.
7,568,322 B2 8/2009 Pervan et al.
7,584,583 B2 9/2009 Bergelin et al.
7,603,826 B1 10/2009 Moebus
7,607,271 B2 10/2009 Griffin et al.
7,614,197 B2 11/2009 Nelson
7,617,645 B2 11/2009 Moriau et al.
7,621,094 B2 11/2009 Moriau et al.
7,634,886 B2 12/2009 Moriau et al.
7,634,887 B2 12/2009 Moriau et al.
7,637,066 B2 12/2009 Moriau et al.
7,640,708 B2 1/2010 Moriau et al.
7,644,555 B2 1/2010 Moriau et al.
7,644,557 B2 1/2010 Moriau et al.
7,647,743 B2 1/2010 Moriau et al.
7,650,728 B2 1/2010 Moriau et al.
7,654,054 B2 2/2010 Moriau et al.
7,658,048 B2 2/2010 Moriau et al.
7,677,001 B2 3/2010 Pervan
7,678,215 B2 3/2010 Martin
7,716,896 B2 5/2010 Pervan
7,739,849 B2 6/2010 Pervan
7,763,345 B2 7/2010 Chen et al.
7,779,597 B2 8/2010 Thiers et al.
7,802,415 B2 9/2010 Pervan
7,841,144 B2 11/2010 Pervan
7,841,150 B2 11/2010 Pervan
7,856,784 B2 12/2010 Martensson
7,856,789 B2 12/2010 Eisermann
7,861,482 B2 1/2011 Pervan
7,866,110 B2 1/2011 Pervan
7,886,497 B2 2/2011 Pervan et al.
7,896,571 B1 3/2011 Hannig et al.
7,930,862 B2 4/2011 Bergelin et al.
7,958,689 B2 6/2011 Lei
7,980,043 B2 7/2011 Moebus
7,984,600 B2 7/2011 Alford et al.
8,006,460 B2 8/2011 Chen et al.
8,021,741 B2 9/2011 Chen et al.
8,028,486 B2 10/2011 Pervan

(56) References Cited

U.S. PATENT DOCUMENTS 8,037,656 B2 10/2011 Liu
8,038,363 B2 10/2011 Hannig
8,042,311 B2 10/2011 Pervan et al.
8,071,193 B2 12/2011 Windmöller
8,091,238 B2 1/2012 Hannig et al.
8,099,924 B2 1/2012 Braun
8,112,891 B2 2/2012 Pervan
8,132,384 B2 3/2012 Hannig
8,166,718 B2 5/2012 Liu
8,191,333 B2 6/2012 Braun
8,196,366 B2 6/2012 Thiers
8,215,078 B2 7/2012 Pervan
8,234,829 B2 8/2012 Thiers et al.
8,245,478 B2 8/2012 Bergelin et al.
8,281,549 B2 10/2012 Du
8,293,058 B2 10/2012 Pervan et al.
8,353,140 B2 1/2013 Pervan et al.
8,356,452 B2 1/2013 Thiers et al.
8,365,499 B2 2/2013 Nilsson et al.
8,375,672 B2 2/2013 Hannig
8,375,674 B2 2/2013 Braun
8,480,841 B2 7/2013 Pervan et al.
8,484,924 B2 7/2013 Braun
8,490,361 B2 7/2013 Curry et al.
8,499,521 B2 8/2013 Pervan et al.
8,511,031 B2 8/2013 Bergelin et al.
8,544,231 B2 10/2013 Hannig
8,544,232 B2 10/2013 Wybo et al.
8,544,234 B2 10/2013 Pervan et al.
8,584,423 B2 11/2013 Pervan et al.
8,613,826 B2 12/2013 Pervan et al.
8,658,274 B2 2/2014 Chen et al.
8,707,651 B2 4/2014 Stockl
8,720,149 B2 5/2014 Bossuyt
8,726,604 B2 5/2014 Hannig
8,745,952 B2 6/2014 Perra et al.
8,756,899 B2 6/2014 Nilsson et al.
8,763,340 B2 7/2014 Pervan et al.
8,800,150 B2 8/2014 Pervan
8,806,832 B2 8/2014 Kell
8,833,028 B2 9/2014 Whispell et al.
8,834,992 B2 9/2014 Chen et al.
8,952,078 B2 2/2015 Gould
8,966,853 B2 3/2015 Hannig
8,978,336 B2 3/2015 Perra
9,103,126 B2 8/2015 Kell
9,212,492 B2 12/2015 Pervan et al.
9,217,250 B2 12/2015 Perra
9,222,267 B2 12/2015 Bergelin et al.
9,228,360 B2 1/2016 Schneider
9,249,581 B2 2/2016 Nilsson et al.
9,260,870 B2 2/2016 Vermeulen et al.
9,296,191 B2 3/2016 Pervan et al.
9,314,936 B2 4/2016 Pervan
9,371,653 B2 6/2016 Liu
9,410,328 B2 8/2016 Pervan
9,528,278 B2 12/2016 Cappelle
9,650,792 B2 5/2017 Ramachandra
9,695,600 B2 7/2017 Vandervoorde
9,695,601 B2 7/2017 Whispell et al.
9,695,851 B2 7/2017 Hanning
9,714,515 B2 7/2017 Pervan
9,745,758 B2 8/2017 Baert et al.
9,765,530 B2 9/2017 Bergelin et al.
9,777,487 B2 10/2017 Pervan et al.
9,803,374 B2 10/2017 Pervan
9,816,270 B2 11/2017 Pervan et al.
9,874,035 B2 1/2018 Wagner
9,885,186 B2 2/2018 Liu
9,885,187 B2 2/2018 Kell
10,000,935 B2 6/2018 Kell
10,047,527 B2 8/2018 Nilsson et al.
10,059,084 B2 8/2018 Lundblad et al.
10,113,318 B2 10/2018 Cappelle
10,137,659 B2 11/2018 Pervan
10,214,917 B2 2/2019 Pervan et al.
10,287,777 B2 5/2019 Boo et al.
10,301,830 B2 5/2019 Boo
10,316,526 B2 6/2019 Kell
10,344,379 B2 7/2019 Pervan
10,407,919 B2 9/2019 Boo
10,450,760 B2 10/2019 Bergelin et al.
10,486,399 B2 11/2019 Chen et al.
10,493,731 B2 12/2019 Lundblad et al.
10,526,793 B2 1/2020 Nilsson et al.
10,704,269 B2 7/2020 Whispell et al.
10,780,676 B2 9/2020 Lundblad et al.
10,808,410 B2 10/2020 Boo et al.
10,837,181 B2 11/2020 Josefsson et al.
10,844,612 B2 11/2020 Boo
10,851,549 B2 12/2020 Boo
10,865,571 B2 12/2020 Kell
10,975,580 B2 4/2021 Pervan et al.
10,982,449 B2 4/2021 Kell
11,066,836 B2 7/2021 Bergelin et al.
2001/0021431 A1 9/2001 Chen
2002/0007606 A1 1/2002 Kettler
2002/0007608 A1 1/2002 Pervan
2002/0007609 A1 1/2002 Pervan
2002/0031646 A1 3/2002 Chen
2002/0069611 A1 6/2002 Leopolder
2002/0092263 A1 7/2002 Schulte
2002/0142135 A1 10/2002 Chen et al.
2002/0152707 A1 10/2002 Martensson
2002/0170258 A1 11/2002 Schwitte et al.
2002/0178674 A1 12/2002 Pervan
2002/0178681 A1 12/2002 Zancai
2002/0189183 A1 12/2002 Ricciardelli
2003/0009971 A1 1/2003 Palmberg
2003/0024199 A1 2/2003 Pervan
2003/0024200 A1 2/2003 Moriau et al.
2003/0037504 A1 2/2003 Schwitte et al.
2003/0041545 A1 3/2003 Stanchfield
2003/0101674 A1 6/2003 Pervan et al.
2003/0101681 A1 6/2003 Tychsen
2003/0110720 A1 6/2003 Berard et al.
2003/0180091 A1 9/2003 Stridsman
2003/0188504 A1 10/2003 Eisermann
2003/0196405 A1 10/2003 Pervan
2003/0224147 A1 12/2003 Maine et al.
2004/0031225 A1 2/2004 Fowler
2004/0031227 A1 2/2004 Knauseder
2004/0060255 A1 4/2004 Knauseder
2004/0068954 A1 4/2004 Martensson
2004/0128934 A1 7/2004 Hecht
2004/0137180 A1 7/2004 Sjoberg et al.
2004/0139678 A1 7/2004 Pervan
2004/0177584 A1 9/2004 Pervan
2004/0182036 A1 9/2004 Sjoberg et al.
2004/0206036 A1 10/2004 Pervan
2004/0211143 A1 10/2004 Hannig
2004/0211144 A1 10/2004 Stanchfield
2004/0219339 A1 11/2004 Dempsey et al.
2004/0241374 A1 12/2004 Thiers
2004/0255538 A1 12/2004 Ruhdorfer
2004/0255541 A1 12/2004 Thiers et al.
2004/0261348 A1 12/2004 Vulin
2005/0003160 A1 1/2005 Chen et al.
2005/0028474 A1 2/2005 Kim
2005/0112320 A1 5/2005 Wright
2005/0138881 A1 6/2005 Pervan
2005/0144881 A1 7/2005 Tate et al.
2005/0166514 A1 8/2005 Pervan
2005/0176321 A1 8/2005 Crette et al.
2005/0021081 A1 9/2005 Pervan
2005/0193677 A1 9/2005 Vogel
2005/0208255 A1 9/2005 Pervan
2005/0221073 A1 10/2005 Liou
2005/0235593 A1 10/2005 Hecht
2005/0247000 A1 11/2005 Zhu
2005/0250921 A1 11/2005 Qiu et al.
2005/0252130 A1 11/2005 Martensson
2005/0268570 A2 12/2005 Pervan
2006/0010820 A1 1/2006 Schwitte

(56) References Cited

U.S. PATENT DOCUMENTS

| | | | |
|---|---|---|---|
| 2006/0032168 | A1 | 2/2006 | Thiers et al. |
| 2006/0032175 | A1 | 2/2006 | Chen et al. |
| 2006/0053724 | A1 | 3/2006 | Braun et al. |
| 2006/0070333 | A1 | 4/2006 | Pervan |
| 2006/0101769 | A1 | 5/2006 | Pervan et al. |
| 2006/0154015 | A1 | 7/2006 | Miller et al. |
| 2006/0156666 | A1 | 7/2006 | Caufield |
| 2006/0174974 | A1 | 8/2006 | Brannstrom et al. |
| 2006/0225377 | A1 | 10/2006 | Moriau et al. |
| 2006/0236642 | A1 | 10/2006 | Pervan |
| 2006/0248830 | A1 | 11/2006 | Moriau et al. |
| 2006/0248831 | A1 | 11/2006 | Moriau et al. |
| 2006/0260252 | A1 | 11/2006 | Brice |
| 2006/0260254 | A1 | 11/2006 | Pervan |
| 2007/0006543 | A1 | 1/2007 | Engstrom |
| 2007/0011981 | A1 | 1/2007 | Eiserman |
| 2007/0022694 | A1 | 2/2007 | Chen et al. |
| 2007/0028547 | A1 | 2/2007 | Grafenauer et al. |
| 2007/0094986 | A1 | 5/2007 | Moriau et al. |
| 2007/0094987 | A1 | 5/2007 | Moriau et al. |
| 2007/0130872 | A1 | 6/2007 | Goodwin |
| 2007/0151189 | A1 | 7/2007 | Yang |
| 2007/0151191 | A1 | 7/2007 | August |
| 2007/0154840 | A1 | 7/2007 | Thies et al. |
| 2007/0175148 | A1 | 8/2007 | Bergelin et al. |
| 2007/0175156 | A1 | 8/2007 | Pervan et al. |
| 2007/0184230 | A1 | 8/2007 | Verrue et al. |
| 2007/0193178 | A1 | 8/2007 | Groeke et al. |
| 2007/0196624 | A1 | 8/2007 | Chen et al. |
| 2007/0218252 | A1 | 9/2007 | Donald |
| 2007/0275207 | A1 | 11/2007 | Higgins et al. |
| 2008/0000182 | A1 | 1/2008 | Pervan |
| 2008/0000183 | A1 | 1/2008 | Bergelin et al. |
| 2008/0000186 | A1 | 1/2008 | Pervan et al. |
| 2008/0000188 | A1 | 1/2008 | Pervan |
| 2008/0010931 | A1 | 1/2008 | Pervan et al. |
| 2008/0010937 | A1 | 1/2008 | Pervan |
| 2008/0028707 | A1 | 2/2008 | Pervan |
| 2008/0028713 | A1 | 2/2008 | Pervan |
| 2008/0029490 | A1 | 2/2008 | Martin, Jr. et al. |
| 2008/0034701 | A1 | 2/2008 | Pervan |
| 2008/0034708 | A1 | 2/2008 | Pervan |
| 2008/0041007 | A1 | 2/2008 | Pervan |
| 2008/0053028 | A1 | 3/2008 | Moriau et al. |
| 2008/0060309 | A1 | 3/2008 | Moriau et al. |
| 2008/0060310 | A1 | 3/2008 | Moriau et al. |
| 2008/0092473 | A1 | 4/2008 | Heyns |
| 2008/0104921 | A1 | 5/2008 | Pervan et al. |
| 2008/0110125 | A1 | 5/2008 | Pervan |
| 2008/0134607 | A1 | 6/2008 | Pervan |
| 2008/0134613 | A1 | 6/2008 | Pervan |
| 2008/0134614 | A1 | 6/2008 | Pervan |
| 2008/0138560 | A1 | 6/2008 | Windmöller |
| 2008/0141610 | A1 | 6/2008 | Thiers |
| 2008/0148674 | A1 | 6/2008 | Thiers et al. |
| 2008/0153609 | A1 | 6/2008 | Kotler |
| 2008/0172971 | A1 | 7/2008 | Pervan |
| 2008/0184646 | A1 | 8/2008 | Alford |
| 2008/0241440 | A1 | 10/2008 | Bauer |
| 2008/0256890 | A1 | 10/2008 | Pervan |
| 2008/0311355 | A1 | 12/2008 | Chen et al. |
| 2009/0031662 | A1 | 2/2009 | Chen et al. |
| 2009/0038253 | A1 | 2/2009 | Martensson |
| 2009/0049787 | A1 | 2/2009 | Hannig |
| 2009/0110888 | A1 | 4/2009 | Wuest et al. |
| 2009/0133353 | A1 | 5/2009 | Pervan et al. |
| 2009/0151290 | A1 | 6/2009 | Liu |
| 2009/0159156 | A1 | 6/2009 | Walker |
| 2009/0186710 | A1 | 7/2009 | Joseph |
| 2009/0193748 | A1 | 8/2009 | Boo |
| 2009/0217611 | A1 | 9/2009 | Schrader |
| 2009/0223162 | A1 | 9/2009 | Chen et al. |
| 2009/0226662 | A1 | 9/2009 | Dyczko-Riglin et al. |
| 2009/0235604 | A1 | 9/2009 | Cheng et al. |
| 2009/0249733 | A1 | 10/2009 | Moebus |
| 2009/0260313 | A1 | 10/2009 | Segaert |
| 2009/0272058 | A1 | 11/2009 | Duselis et al. |
| 2009/0320402 | A1 | 12/2009 | Schacht et al. |
| 2010/0011695 | A1 | 1/2010 | Cheng |
| 2010/0018149 | A1 | 1/2010 | Thiers |
| 2010/0031594 | A1 | 2/2010 | Liu |
| 2010/0043333 | A1 | 2/2010 | Hannig et al. |
| 2010/0058702 | A1 | 3/2010 | Lei |
| 2010/0260962 | A1 | 10/2010 | Chen et al. |
| 2010/0293879 | A1 | 11/2010 | Pervan et al. |
| 2010/0300029 | A1 | 12/2010 | Braun et al. |
| 2010/0319293 | A1 | 12/2010 | Dammers et al. |
| 2011/0001420 | A1 | 1/2011 | Tchakarov et al. |
| 2011/0008567 | A1 | 1/2011 | Weeks et al. |
| 2011/0030303 | A1 | 2/2011 | Pervan et al. |
| 2011/0041996 | A1 | 2/2011 | Pervan |
| 2011/0056167 | A1 | 3/2011 | Nilsson et al. |
| 2011/0094178 | A1 | 4/2011 | Braun |
| 2011/0131901 | A1 | 6/2011 | Pervan et al. |
| 2011/0131909 | A1 | 6/2011 | Hannig |
| 2011/0138722 | A1 | 6/2011 | Hannig |
| 2011/0146177 | A1 | 6/2011 | Hannig |
| 2011/0154763 | A1 | 6/2011 | Bergelin et al. |
| 2011/0167744 | A1 | 7/2011 | Whispell et al. |
| 2011/0173914 | A1 | 7/2011 | Engstrom |
| 2011/0247285 | A1 | 10/2011 | Wybo |
| 2011/0247748 | A1 | 10/2011 | Pervan et al. |
| 2011/0258959 | A1 | 10/2011 | Braun |
| 2011/0296780 | A1 | 12/2011 | Windmöller |
| 2012/0003439 | A1 | 1/2012 | Chen et al. |
| 2012/0017534 | A1 | 1/2012 | Oh |
| 2012/0040149 | A1 | 2/2012 | Chen et al. |
| 2012/0066996 | A1 | 3/2012 | Konstanczak |
| 2012/0067461 | A1 | 3/2012 | Braun |
| 2012/0124932 | A1 | 5/2012 | Schulte et al. |
| 2012/0137617 | A1 | 6/2012 | Pervan |
| 2012/0174519 | A1 | 7/2012 | Schulte |
| 2012/0174521 | A1 | 7/2012 | Schulte |
| 2012/0180416 | A1 | 7/2012 | Perra et al. |
| 2012/0192521 | A1 | 8/2012 | Schulte |
| 2012/0216472 | A1 | 8/2012 | Martensson |
| 2012/0266555 | A1 | 10/2012 | Cappelle |
| 2012/0276369 | A1 | 11/2012 | Jing et al. |
| 2012/0279154 | A1 | 11/2012 | Bergelin et al. |
| 2012/0304581 | A1 | 12/2012 | Kim |
| 2013/0008118 | A1 | 1/2013 | Baert et al. |
| 2013/0014890 | A1 | 1/2013 | Pervan et al. |
| 2013/0025964 | A1 | 1/2013 | Ramachandra et al. |
| 2013/0042563 | A1 | 2/2013 | Pervan et al. |
| 2013/0042565 | A1 | 2/2013 | Pervan et al. |
| 2013/0047536 | A1 | 2/2013 | Pervan |
| 2013/0097959 | A1 | 4/2013 | Michel |
| 2013/0111758 | A1 | 5/2013 | Nilsson et al. |
| 2013/0152492 | A1 | 6/2013 | Whitaker |
| 2013/0160391 | A1 | 6/2013 | Pervan et al. |
| 2013/0174507 | A1 | 7/2013 | Oehrlein |
| 2013/0212971 | A1 | 8/2013 | Cordeiro |
| 2013/0243996 | A1 | 9/2013 | Hannig |
| 2013/0269863 | A1 | 10/2013 | Pervan et al. |
| 2013/0283719 | A1 | 10/2013 | Döhring et al. |
| 2013/0298487 | A1 | 11/2013 | Bergelin et al. |
| 2013/0305650 | A1 | 11/2013 | Liu |
| 2013/0309441 | A1 | 11/2013 | Hannig |
| 2013/0333182 | A1 | 12/2013 | Pervan et al. |
| 2014/0007539 | A1 | 1/2014 | Pervan et al. |
| 2014/0033633 | A1 | 2/2014 | Kell |
| 2014/0033635 | A1 | 2/2014 | Pervan et al. |
| 2014/0069043 | A1 | 3/2014 | Pervan |
| 2014/0069044 | A1 | 3/2014 | Wallin |
| 2014/0115994 | A1 | 5/2014 | Pervan |
| 2014/0186104 | A1 | 7/2014 | Hamberger |
| 2014/0215946 | A1 | 8/2014 | Roy et al. |
| 2014/0237924 | A1 | 8/2014 | Nilsson et al. |
| 2014/0283466 | A1 | 9/2014 | Boo |
| 2014/0283477 | A1 | 9/2014 | Hannig |
| 2014/0290173 | A1 | 10/2014 | Hamberger |
| 2014/0318061 | A1 | 10/2014 | Pervan |
| 2014/0325930 | A1 | 11/2014 | Schneider |
| 2014/0352248 | A1 | 12/2014 | Whispell et al. |

(56) References Cited

U.S. PATENT DOCUMENTS

| | | | |
|---|---|---|---|
| 2014/0356594 | A1 | 12/2014 | Chen et al. |
| 2014/0366476 | A1 | 12/2014 | Pervan |
| 2014/0366477 | A1 | 12/2014 | Kell |
| 2015/0114552 | A1 | 4/2015 | Cernohous et al. |
| 2015/0225964 | A1 | 8/2015 | Chen et al. |
| 2015/0252573 | A1 | 9/2015 | Devos |
| 2015/0330088 | A1 | 11/2015 | Derelöv |
| 2015/0368910 | A1 | 12/2015 | Kell |
| 2016/0016390 | A1 | 1/2016 | Lundblad et al. |
| 2016/0016391 | A1 | 1/2016 | Lundblad et al. |
| 2016/0047129 | A1 | 2/2016 | Bowers |
| 2016/0052245 | A1 | 2/2016 | Chen et al. |
| 2016/0069089 | A1 | 3/2016 | Bergelin et al. |
| 2016/0076260 | A1 | 3/2016 | Pervan et al. |
| 2016/0108624 | A1 | 4/2016 | Nilsson et al. |
| 2016/0115695 | A1 | 4/2016 | Devos |
| 2016/0138274 | A1 | 5/2016 | Anspach et al. |
| 2016/0186318 | A1 | 6/2016 | Pervan et al. |
| 2016/0194883 | A1 | 7/2016 | Pervan |
| 2016/0194885 | A1 | 7/2016 | Whispell et al. |
| 2016/0201324 | A1 | 7/2016 | Håkansson et al. |
| 2016/0265234 | A1 | 9/2016 | Pervan |
| 2016/0333595 | A1 | 11/2016 | Cappelle |
| 2016/0375674 | A1 | 12/2016 | Schulte |
| 2017/0030088 | A1 | 2/2017 | Simoens |
| 2017/0037642 | A1 | 2/2017 | Boo |
| 2017/0037645 | A1 | 2/2017 | Pervan |
| 2017/0175400 | A1 | 6/2017 | Joseffson et al. |
| 2017/0241136 | A1 | 8/2017 | Kell |
| 2017/0350140 | A1 | 12/2017 | Bergelin et al. |
| 2017/0362834 | A1 | 12/2017 | Pervan et al. |
| 2017/0370109 | A1 | 12/2017 | Devos |
| 2018/0010342 | A1 | 1/2018 | Van Hooydonck |
| 2018/0094441 | A1 | 4/2018 | Boo et al. |
| 2018/0313093 | A1 | 11/2018 | Nilsson et al. |
| 2019/0017278 | A1 | 1/2019 | De Rick et al. |
| 2019/0091977 | A1 | 3/2019 | Lundblad et al. |
| 2019/0136545 | A1 | 5/2019 | De Rick et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2019/0394314 | A1 | 12/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0362567 | A1 | 11/2020 | Nilsson et al. |
| 2020/0407981 | A1 | 12/2020 | Boo et al. |
| 2021/0115680 | A1 | 4/2021 | Whispell et al. |
| 2021/0214953 | A1 | 7/2021 | Kell |
| 2021/0230881 | A1 | 7/2021 | Boo |

FOREIGN PATENT DOCUMENTS

| | | | |
|---|---|---|---|
| DE | 20 2005 004 537 | U1 | 6/2005 |
| DE | 198 54 475 | B4 | 6/2006 |
| DE | 10 2005 061 099 | A1 | 3/2007 |
| DE | 10 2006 024 184 | A1 | 11/2007 |
| DE | 20 2008 011 589 | U1 | 11/2008 |
| DE | 20 2008 012 001 | U1 | 11/2008 |
| DE | 20 2004 021 867 | U1 | 12/2011 |
| DE | 20 2016 102 034 | U1 | 5/2016 |
| EP | 1 045 083 | A1 | 10/2000 |
| EP | 1 045 083 | B1 | 10/2002 |
| EP | 1 308 577 | A2 | 5/2003 |
| EP | 1 350 904 | A2 | 10/2003 |
| EP | 1 350 904 | A3 | 10/2003 |
| EP | 1 420 125 | A2 | 5/2004 |
| EP | 1 585 875 | | 10/2005 |
| EP | 1 585 875 | B1 | 10/2006 |
| EP | 1 570 143 | | 5/2007 |
| EP | 2 339 092 | A1 | 6/2011 |
| EP | 2 615 221 | A1 | 7/2013 |
| FR | 1 293 043 | | 4/1962 |
| GB | 1 430 423 | A | 3/1976 |
| JP | S60-255843 | A | 12/1985 |
| JP | H07-180333 | A | 7/1995 |
| JP | H07-300979 | | 11/1995 |
| JP | H08-74405 | A | 3/1996 |
| KR | 1996-0005785 | | 7/1996 |
| KR | 10-2008-0096189 | | 10/2008 |
| KR | 10-0870496 | | 11/2008 |
| WO | WO 94/26999 | A1 | 11/1994 |
| WO | WO 00/66856 | A1 | 11/2000 |
| WO | WO 01/44669 | A2 | 6/2001 |
| WO | WO 01/44669 | A3 | 6/2001 |
| WO | WO 01/48332 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 03/012224 | A1 | 2/2003 |
| WO | WO 2004/011740 | A2 | 2/2004 |
| WO | WO 2004/016877 | A1 | 2/2004 |
| WO | WO 2005/068747 | A1 | 7/2005 |
| WO | WO 2005/088029 | A1 | 9/2005 |
| WO | WO 2005/098163 | A1 | 10/2005 |
| WO | WO 2006/032378 | A1 | 3/2006 |
| WO | WO 2006/043893 | A1 | 4/2006 |
| WO | WO 2006/104436 | A1 | 10/2006 |
| WO | WO 2006/123988 | A1 | 11/2006 |
| WO | WO 2006/1 33690 | A1 | 12/2006 |
| WO | WO 2007/015669 | A2 | 2/2007 |
| WO | WO 2007/015669 | A3 | 2/2007 |
| WO | WO 2007/016978 | | 2/2007 |
| WO | WO 2007/020088 | A1 | 2/2007 |
| WO | WO 2007/079845 | A1 | 7/2007 |
| WO | WO 2007/118352 | | 10/2007 |
| WO | WO 2008/008016 | A1 | 1/2008 |
| WO | WO 2008/008824 | A1 | 1/2008 |
| WO | WO 2008/068245 | A1 | 6/2008 |
| WO | WO 2008/116623 | A1 | 10/2008 |
| WO | WO 2008/133377 | A1 | 11/2008 |
| WO | WO 2009/061279 | A1 | 5/2009 |
| WO | WO 2009/071822 | A2 | 6/2009 |
| WO | WO 2009/071822 | A3 | 6/2009 |
| WO | WO 2010/015516 | A2 | 2/2010 |
| WO | WO 2010/015516 | A3 | 2/2010 |
| WO | WO 2010/072357 | A2 | 7/2010 |
| WO | WO 2010/072357 | A3 | 7/2010 |
| WO | WO 2010/081532 | A1 | 7/2010 |
| WO | WO 2010/086084 | A1 | 8/2010 |
| WO | WO 2010/114236 | A2 | 10/2010 |
| WO | WO 2010/128043 | A1 | 11/2010 |
| WO | WO 2011/012104 | A2 | 2/2011 |
| WO | WO 2011/012104 | A3 | 2/2011 |
| WO | WO 2011/028171 | A1 | 3/2011 |
| WO | WO 2011/038709 | A1 | 4/2011 |
| WO | WO 2012/084604 | A1 | 6/2012 |
| WO | WO 2012/101171 | A1 | 8/2012 |
| WO | WO 2012/126046 | A1 | 9/2012 |
| WO | WO 2012/136021 | A1 | 10/2012 |
| WO | WO 2013/017575 | A1 | 2/2013 |
| WO | WO 2013/026559 | A2 | 2/2013 |
| WO | WO 2013/044758 | A1 | 4/2013 |
| WO | WO 2013/151493 | A1 | 10/2013 |
| WO | WO 2014/007738 | A1 | 1/2014 |
| WO | WO 2014/043756 | A1 | 3/2014 |
| WO | WO 2014/182215 | A1 | 11/2014 |
| WO | WO 2014/209213 | A1 | 12/2014 |
| WO | WO 2015/104680 | A1 | 7/2015 |
| WO | WO 2015/174914 | A1 | 11/2015 |
| WO | WO 2016/029255 | A1 | 3/2016 |
| WO | WO 2017/101910 | A1 | 6/2017 |
| WO | WO 2017/115202 | A1 | 7/2017 |
| WO | WO 2017/187298 | A2 | 11/2017 |

OTHER PUBLICATIONS

U.S. Appl. No. 16/887,559, John M Whispell and Hao A Chen, filed May 29, 2020, (Cited herein as US Patent Application Publication No. 2021/0115680 A1 of Apr. 22, 2021).

(56) References Cited

OTHER PUBLICATIONS

U.S. Appl. No. 17/017,085, Christian Boo, Marcus Nilsson Ståhl and Anders Nilsson, filed Sep. 10, 2020, (Cited herein as US Patent Application Publication No. 2020/0407981 A1 of Dec. 31, 2020).
U.S. Appl. No. 17/067,989, Christian Boo, filed Oct. 12, 2020, (Cited herein as US Patent Application Publication No. 2021/0230881 A1 of Jul. 29, 2021).
U.S. Appl. No. 17/094,226, Richard William Kell, filed Nov. 10, 2020, (Cited herein as US Patent Application Publication No. 2021/0214953 A1 of Jul. 15, 2021).
International Search Report issued in PCT/SE2017/050030, dated May 18, 2017, Patent-och registreringsverket, Stockholm, SE, 4 pages.
Extended European Search Report dated Jun. 8, 2020 in EP 17856900.0, European Patent Office, Munich, DE, 10 pages.
Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages.
Communication Pursuant to Article 94(3) EPC dated Oct. 13, 2017 in EP Patent Application No. 14 794 996.0, EPO, Munich, DE, 9 pages.
U.S. Appl. No. 17/694,843, filed Mar. 15, 2022, Mats Nilsson and Per Nygren.
Nilsson et al., U.S. Appl. No. 17/694,843 entitled "Resilient Floor", filed Mar. 15, 2022.

KNOWN TECHNOLOGY

SET OF PANELS

CROSS REFERENCE TO RELATED APPLICATIONS

The present application is a continuation of U.S. application Ser. No. 16/366,173, filed on Mar. 27, 2019, which is a continuation of U.S. application Ser. No. 15/404,617, filed on Jan. 12, 2017, now U.S. Pat. No. 10,287,777, which claims the benefit of Swedish Application No. 1651290-7, filed on Sep. 30, 2016. The entire contents of each of U.S. application Ser. No. 16/366,173, U.S. application Ser. No. 15/404,617, and Swedish Application No. 1651290-7 are hereby incorporated herein by reference in their entirety.

TECHNICAL FIELD

Embodiments of the present invention relates to panels, such as floorboards, which are configured to be locked together by a vertical displacement.

BACKGROUND

Panels are known that are configured to be assembled by a vertical displacement and to be locked together in a vertical direction and in a horizontal direction. Such panels are disclosed in, e.g., WO2014/182215. A tongue and groove connection locks a first edge of a first panel to a second edge of the second panel. The first and the second edge furthermore comprise a locking element configured to cooperate with a locking groove for locking in the vertical and the horizontal direction.

Embodiments of the present invention address a need to provide an easier assembling and/or an increased locking strength of the panels.

SUMMARY

It is an object of at least certain embodiments of the present invention to provide an improvement over the above described techniques and known art.

A further object of at least certain embodiments of the present invention is to facilitate assembling of panels configured to be assembled by a vertical displacement and locked together in the vertical direction and the horizontal direction.

Another object of at least certain embodiment of the present invention is to increase the locking strength by preventing or at least decreasing damage of edges of the panels, particularly parts of the edges that have a locking function. The locking strength may also be increased by an improved configuration of locking surfaces at the edges of the panels.

At least some of these and other objects and advantages that may be apparent from the description have been achieved by an aspect of the invention comprising a set of panels comprising a first panel and a second panel. The first edge of the first panel and a second edge of the second are configured to be locked together and assembled by a vertical displacement of the second edge relative the first edge. The first edge comprises a locking element configured to cooperate with a locking groove at the second edge for locking in a horizontal and in the vertical direction. The first edge comprises a tongue configured to cooperate with a tongue groove at the second edge for locking in a vertical direction. An upper part of the first edge comprises a first guiding surface and a lower edge of a lower lip of the tongue groove comprises a second guiding surface, which are configured to cooperate during the vertical displacement. An upper part of the locking element comprises a third guiding surface and a lower edge of the locking groove comprises a fourth guiding surface, which are configured to cooperate during the vertical displacement. A tip of the tongue comprises a fifth guiding surface and a tip of the lower lip of the tongue groove comprises a sixth guiding surface, which are configured to cooperate during the vertical displacement.

The three pairs of guiding surface may have the advantage that damages of particularly the tongue may be prevented during the vertical displacement.

The tongue at the first edge, at the same edge as the locking element, may provide an improved guiding and at the same time an improved configuration for the cooperation with the tongue groove.

The third and the fourth guiding surfaces and fifth and the sixth guiding surfaces, respectively, may be configure cooperate at the same time during the vertical displacement.

The first and the second guiding surfaces may be configured to cooperate at a first guiding position, during the vertical displacement, before a second guiding position comprising the guiding by the third and the fourth guiding surfaces. This may have the advantage that the second edge is in a correct position relative the first edge when edges are guided by the third and the fourth guiding surfaces and fifth and the sixth guiding surfaces. This second guiding position may occur at the same time as a bending of the locking strip and/or a compressing of parts of the first and the second edge in order to displace the first and the second edge to a locked position. The bending and the compression involve a stress of the first and the second edges. A correct position may decrease the stress.

The fifth and the sixth guiding surfaces may be essentially parallel, preferably parallel and/or essentially vertical, preferably vertical.

The first guiding surface may be positioned above the fifth guiding surface.

The second guiding surface may be positioned below the fifth guiding surface.

An upper lip of the tongue groove may be configured to overlap the first guiding surface in a locked position of the first and the second edge.

A lower surface of the upper lip may be configured cooperate with the first guiding surface for restraining penetration of moisture and/or dirt between the first and the second edge in the locked position.

The first guiding surface may be a bevel or a rounding of the uppermost part of the first edge.

The first guiding surface may be adjacent, preferably transition into, the fifth guiding surface. A close positioning of the first guiding surface and the fifth guiding surface may provide room for a larger guiding surface that may improve the guiding.

A locking strip may protrude from the first edge under the tongue, wherein the locking strip comprises the locking element.

A first locking surface of the locking element may be configured to cooperate with a second locking surface of the locking groove for locking in the vertical and the horizontal direction, wherein a first angle between the first locking surface and an upper surface of the first panel is preferably within the range of about 45° to about 85°, preferably within the range of about 60° to about 85° or preferably about 80°.

The tip of the tongue may have a blunt shape which may improve the strength of the tip.

The tip of the lower lip of the tongue groove may have a blunt shape which may improve the strength of the tip.

The first edge and the second edge are preferably produced by mechanically cutting, such as milling.

The locking surfaces and the guiding surface may comprise a material of the core of the first panel and/or the second panel.

The first panel and the second panel may be resilient panels. The resilient panels may comprise a core comprising thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The first panel and the second panel may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The firs panel and the second panel may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

Embodiments of the invention may be particularly advantageous for panels comprising guiding surfaces with higher friction and a tongue comprising a less elastic thermoplastic material.

The first and the second panel may comprise a wood-based core, such as HDF, MDF or plywood.

The first guiding surface preferably extends through the decorative layer and/or the wear layer and a part of the first guiding surface comprises material of the core.

The first panel and the second panel may be configured to be disassembled by downwardly rotating the first and/or the second panel.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DESCRIPTION OF EMBODIMENTS

Figure 1A:
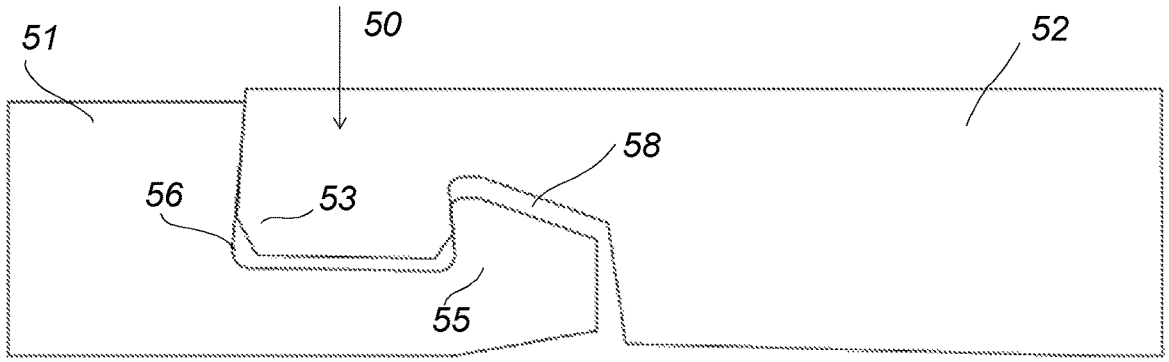
FIGS. 1A-1B show known panels configured to be locked together.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Figure 1B:
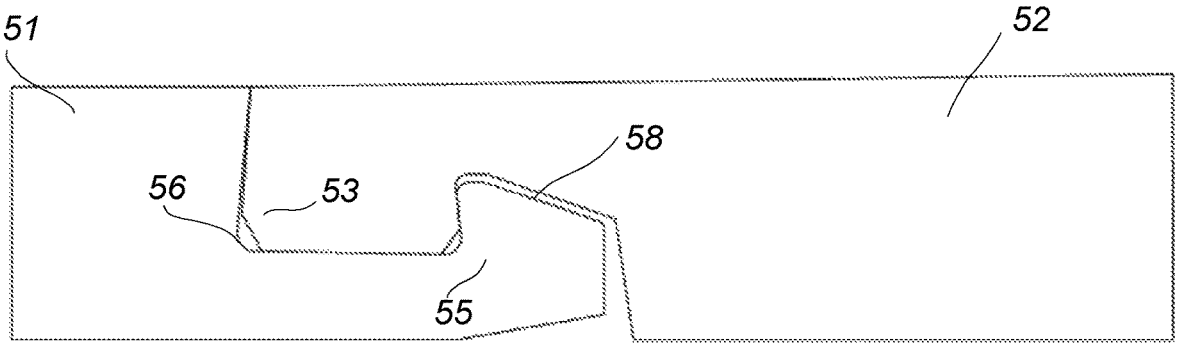

A known set of panels, such as floorboards, are shown in FIG. 1A-1B. The set comprising a first panel 51 and a second panel 52. A first edge of the first panel is configured to be locked to a second edge of the second panel. The first edge and the second edge is assembled by a relative vertical displacement 50. The first edge comprising a tongue groove 56 and the second edge comprises a tongue 53 which are configured for locking the first edge to the second edge in a vertical direction. The first edge comprises a protruding locking strip with locking element 55 which is configured to cooperate with a locking groove 58 at the second edge for locking in a horizontal direction and the vertical direction.

Figure 2A:
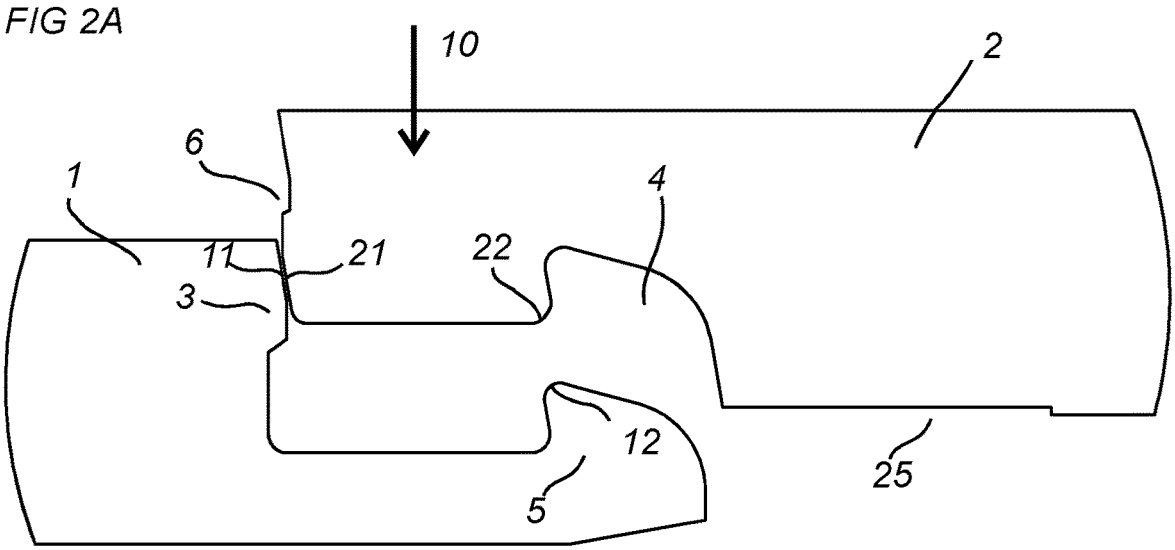
FIGS. 2A-2C show an embodiment of an assembling of an embodiment of a set of panels according to the invention.
Figure 2B:
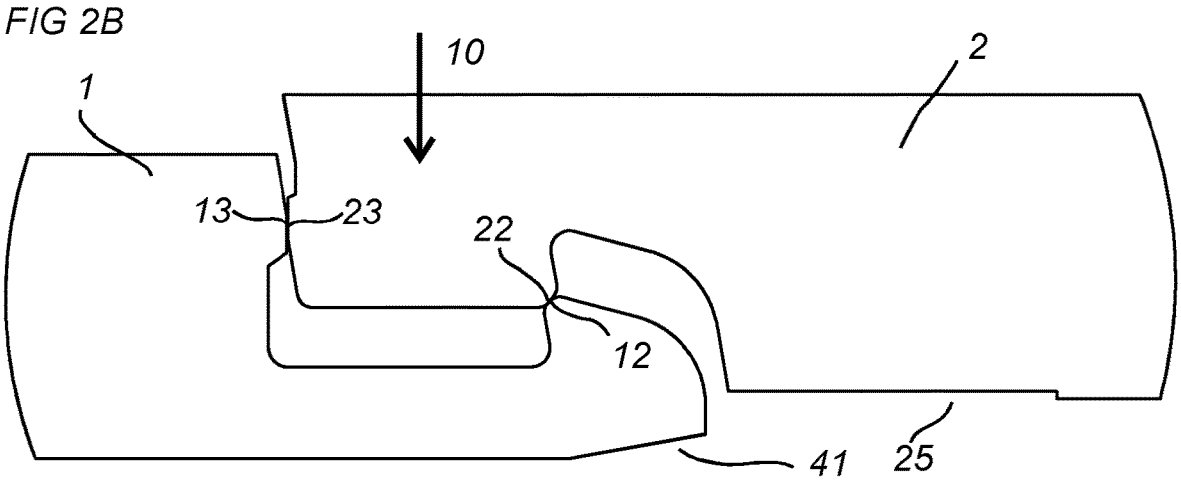
Figure 2C:
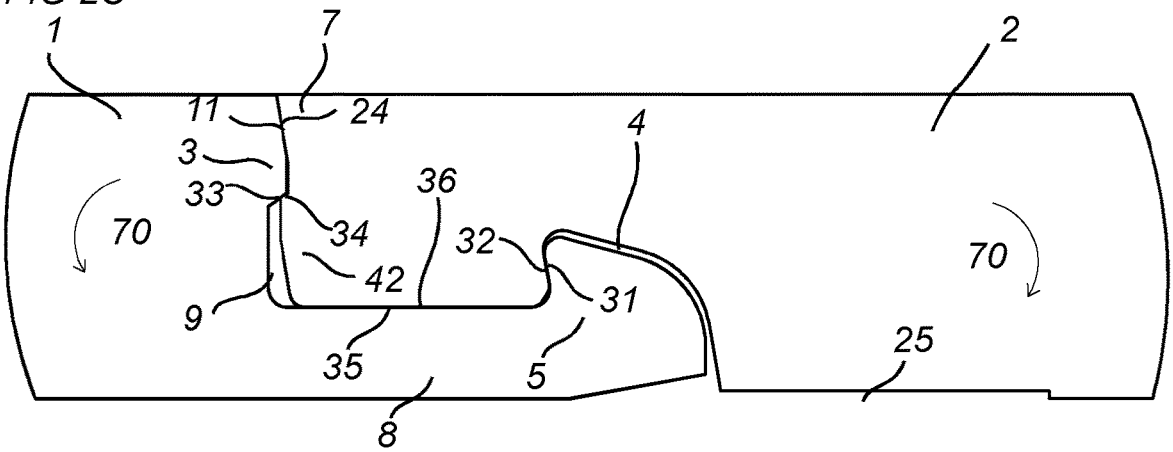
Figure 4A:
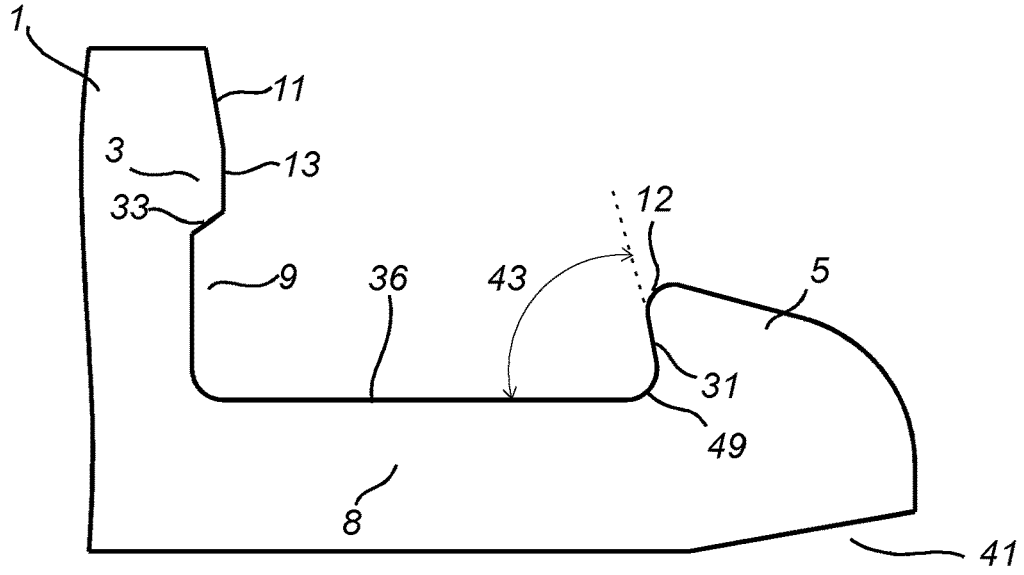
FIGS. 4A-4B show enlargements of edges of the panels shown in FIG. 2A-2C according to an embodiment of the invention.
Figure 4B:
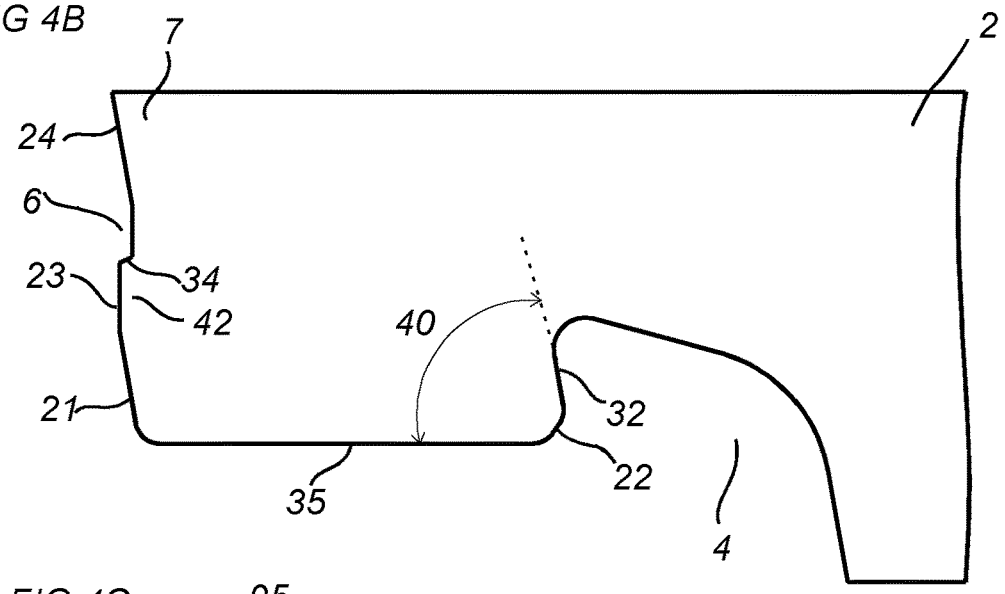

An embodiment of the invention is shown during assembling in FIG. 2A-2C. The embodiment comprises a set of panels comprising a first panel 1 and a second panel 2, wherein a first edge of the first panel and a second edge of the second panel are configured to be locked together and assembled by a vertical displacement 10 of the second edge relative the first edge. An enlargement of the first edge is shown in FIG. 4A and an enlargement of the second edge is shown in FIG. 4B.

The first panel and the second panel may have a thickness in the range of about 3 mm to about 12 mm.

The first edge comprises a locking element 5 configured to cooperate with a locking groove 4 at the second edge for locking in a horizontal direction and in the vertical direction. The first edge comprises a tongue 3 configured to cooperate with a tongue groove 6 at the second edge for locking in a vertical direction. The tongue groove 6 has an upper lip 7 and a lower lip 42. An upper part of the first edge comprises a first guiding surface 11 and a lower edge of the lower lip 42 comprises a second guiding surface 21, which are configured to cooperate during the vertical displacement. An upper part of the locking element comprises a third guiding surface 12 and a lower edge of the locking groove comprises a fourth guiding surface 22, which are configured to cooperate during the vertical displacement. A tip of the tongue comprises a fifth guiding surface 13 and a tip of a lower lip 42 of the tongue groove 6 comprises a sixth guiding surface 23, which are configured to cooperate during the vertical displacement. This embodiment of the invention may be easier to install compared to the known set of panels due to the guiding surfaces. An improved guiding may be critical for assembling panels having surfaces with a high friction and particularly if the panel edges comprise a less elastic material. Without the improved guiding such panels may be difficult to assemble or the panels or part of the panel, e.g., the tongue may break during the assembling.

A first guiding position is shown in FIG. 2A comprising the cooperation between the first guiding surface 11 and the second guiding surface 21.

A second guiding position is shown in FIG. 2B comprising the cooperation between the third guiding surface 12 and the fourth guiding surface 22, and the cooperation between the fifth guiding surface 13 the sixth guiding surface 23.

As is shown in FIG. 2A-2B the embodiment comprises three pairs of guiding surfaces, a first pair comprising the first guiding surface 11 and the second guiding surface 21, a second pair comprising the third guiding surface 12 and the fourth guiding surface 22, and a third pair comprising the fifth guiding surface 13 the sixth guiding surface 23.

The third guiding surface 12 and the fourth guiding surface 22 may be roundings. This embodiment may be advantageous for thinner panels with a thickness of about 3 mm to about 8 mm. The roundings may have a radius which is in the range of about 0.2 mm to about 0.4 mm, or about 0.3 mm. The radius may be in the range of about 5% to about 10% of the thickness of the panels.

The second edge may be provided with a calibrating groove 25 adjacent said locking groove 4. The calibrating groove may compensate for floorboards having different thickness, especially any difference in thickness at the edges of the floorboards. The calibrating groove allows that the second edge may be pushed towards a sub-floor on which the floorboards are arranged. The shown calibrating groove is of a rectangular shape, however the calibrating groove may have other shapes such as a bevel.

A locked position of the first edge and the second edge is shown in FIG. 2C.

A vertical locking both at the tongue and the tongue groove and at the locking element and the locking groove may be an advantage, especially for panels with a locking in a resilient material. The double vertical locking may decrease the risk of unlocking and a separation of the first and the second edges.

The tongue 3 may comprise a locking surface 33 at a lower side and the tongue groove may comprise a locking surface 34 at an upper side of the lower lip 42.

The locking surface 33 of the tongue 3 may be parallel or essentially parallel to the locking surface 34 of the tongue groove.

The tongue 3 at the first edge, at the same edge as the locking element, provides an improved guiding. Furthermore, the locking surfaces 33,34 at the tongue 3 and the lower lip 42 may be larger and at a more advantageous locking angle of the locking surfaces which may increase the locking strength as compared to known locking systems.

The third and the fourth guiding surfaces 12, 22 and fifth and the sixth guiding surfaces 13,23, respectively, are configure cooperate at the same time during the vertical displacement.

The first and the second guiding surfaces 11,21 are configured to cooperate before the third and the fourth guiding surfaces 12,22 during the vertical displacement.

The fifth and the sixth guiding surfaces 13,23 may be essentially parallel to each other, and preferably extend essentially vertical or may be within a range of about 1° to about 5°, or about 2° to the vertical direction.

The first guiding surface 11 is positioned above the fifth guiding surface 13.

The second guiding surface 21 is positioned below the sixth guiding surface 23.

An upper lip 7 of the tongue groove is configured to overlap the first guiding surface 11 in a locked position of the first and the second edge. A lower surface 24 of the upper lip 7 may be configured cooperate with the first guiding surface 11 for restraining penetration of moisture and/or dirt between the first and the second edge in the locked position.

The first guiding surface 11 may be a bevel or a rounding of the uppermost part of the first edge. The first guiding surface 11 may be adjacent, preferably transitions into, the fifth guiding surface 13.

A locking strip 8 protrudes from the first edge under the tongue 3 and the locking strip comprises the locking element 5.

A first locking surface 31 of the locking element 5 is configured to cooperate with a second locking surface 32 of the locking groove 4 for locking in the vertical and the horizontal direction.

A curved surface 49 which is between the first locking surface and an upper surface of the locking strip may be configured to cooperate in the locked position with the fourth guiding surface 22. This may further increase the locking strength in the horizontal direction.

A first locking angle 43 which is between the first locking surface 31 and an upper surface of the first panel may be within the range of about 45° to about 85°, preferably within the range of about 60° to about 85°, or preferably about 80°.

A second locking angle 40 which is between the second locking surface 32 and an upper surface of the second panel may be within the range of about 45° to about 85°, preferably within the range of about 60° to about 85°, or preferably about 80°, and may be essentially equal to the first locking angle 43.

An embodiment of the invention comprises a first locking angle 43 which is larger than the second locking angle, such as about 1-2° larger. This may have the effect that a greater part of a pulling load is applied on curved surface cooperating with fourth guiding surface 22, and that a greater locking strength is obtained.

The locking element may have a first side, an opposite second side and an upper side. The first side is closer to the tongue 3 than the second side. The first locking surface is preferably at the first side. There may be a space between the second side and the locking groove 4. There may be a space between the upper side and the locking groove 4.

The tip of the tongue 3 may have a blunt shape which may improve the strength of the tip and improve the guiding. Each angle between adjacent surfaces, at the tip of the tongue, is preferably more than 90°.

Figure 4C:
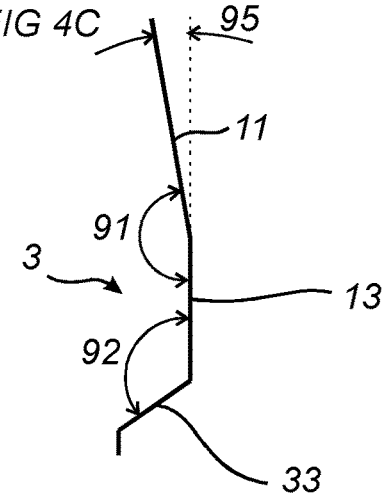
FIGS. 4C-4D show enlargements of an embodiment of tongue and the lower lip, respectively.

FIG. 4C shows an embodiment of the tongue comprising a first tongue angle 91 between the first guiding surface 11 and the fifth guiding surface 13 and a second tongue angle 92 between the fifth guiding surface 13 and the locking surface 33 of the tongue. The first tongue angle 91 may be about 170° or in the range of about 160° to about 175°. The second tongue angle 92 may be about 125° or in the range of about 100° to about 145°, for example in the range of about 110° to about 145°.

A guiding angle between the first guiding surface 11 and the vertical direction may be about 10° or in the range of about 5° to about 20°.

The tip of the lower lip 42 of the tongue groove 6 may have a blunt shape which may improve the strength of the tip and improve the guiding. Each angle between adjacent surfaces, at the tip of the lower lip 42, is preferably more than 90°.

Figure 4D:
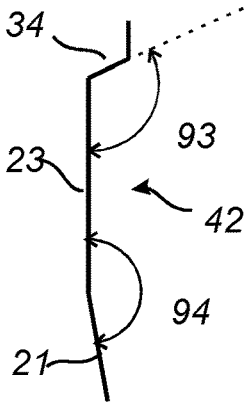

FIG. 4D shows an embodiment of the lower lip 42 comprising a first lip angle 93 between the locking surface 34 of the lower lip 42 and the sixth guiding surface 23 and a second lip angle 94 between the sixth guiding surface 23 and the second guiding surface 21. The first lip angle 93 may be about 125° or in the range of about 100° to about 145°, for example in the range of about 110° to about 145°. The second lip angle 94 may be about 170° or in the range of about 160° to about 175°.

Figure 7A:
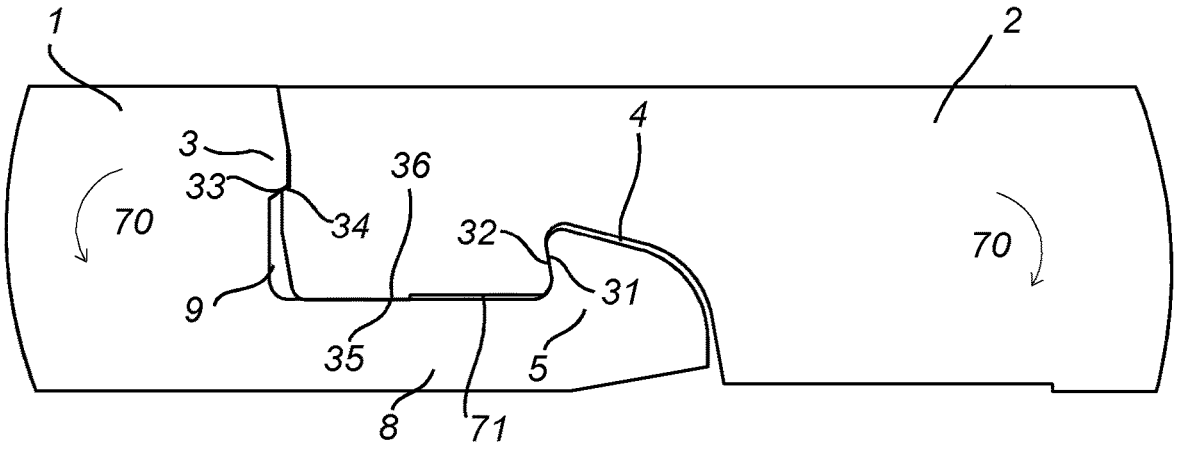
FIGS. 7A-7B show embodiments of a set of panels according to embodiments of the invention.
Figure 7B:
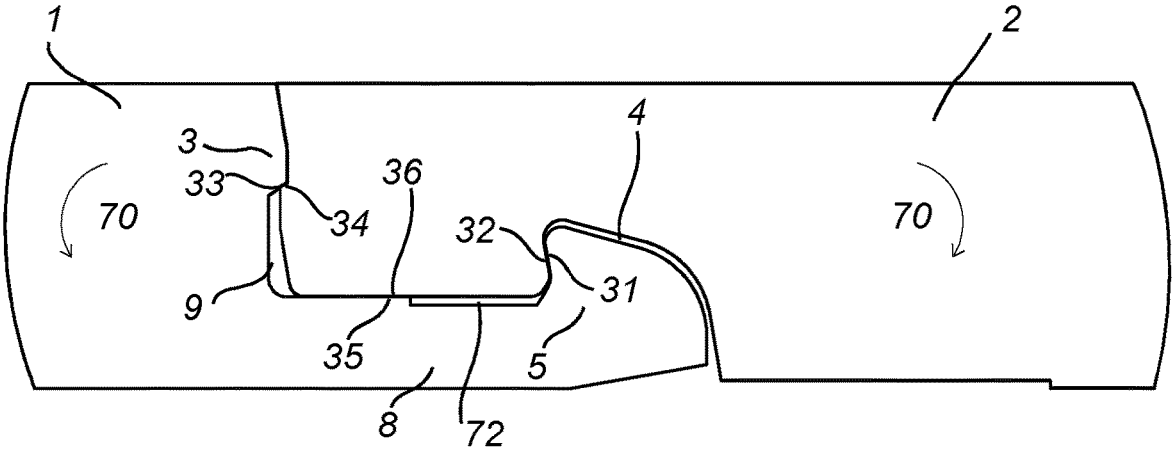
Figure 7C:
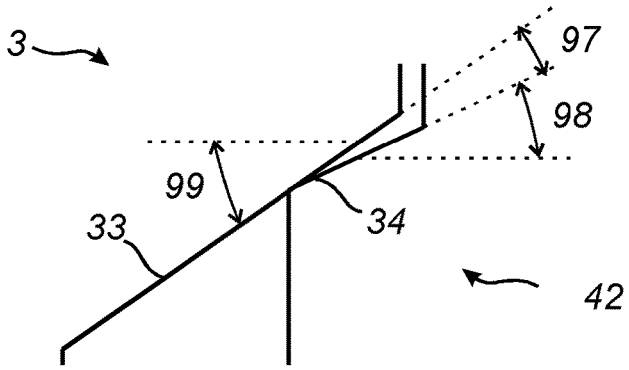
FIG. 7C shows an enlargement of an embodiment of the locking surface of the tongue and of an embodiment of the locking surface of the tongue groove.

FIG. 7C shows an embodiment of the locking surface 33 of the tongue 3 and the locking surface 34 of the tongue groove at the lower lip 42. Said locking surfaces 33,34 are poisoned at a distinguishing angle 97 to each other in the locked position. An advantage may be that locking surface 33 of the tongue may cooperate with the locking surface 34 of the tongue groove even if the locking surfaces are positioned incorrect due to production tolerances and/or dust or other particle between surfaces of the first edge and the second edge. In a locked position with an incorrect positioned locking surface, of the tongue and/or of the tongue groove, the locking strip may stay downwardly bent.

The distinguishing angle 97 between the locking surface 33 of the tongue 3 and the locking surface 34 of the tongue groove may be about 10°, or in the range of about 5° to about 15°.

A first locking surface angle 99 is between the locking surface of the tongue and an upper surface of the first panel. A second locking surface angle 98 is between the locking surface 34 of the tongue groove and an upper surface of the second panel 2. The first locking surface angle 99 is preferably larger than the second surface angle 98.

The first locking surface angle 99 may be about 35° or in the range of about 10° to about 45°, or preferably in the range of about 20° to about 40°.

The second locking surface angle 98 may be about 25° or in the range of about 10° to about 45°, or preferably in the range of about 20° to about 40°.

An upper surface 36 of the locking strip may be configured to cooperate in a locked position with a lower surface 35 of the second edge.

The upper surface 36 of the locking strip may be essentially parallel to an upper surface of the first panel.

The upper surface 36 of the locking strip is preferably parallel to lower surface 35 of the second edge.

The first panel 1 and the second panel 2 may be configured to be disassembled by downwardly rotating 70 the first and/or the second panel, see FIG. 2C.

A lower side of the locking strip may comprise a space 41, such as a recess or bevel, under the locking element to facilitate bending of the locking strip during the assembling.

The first edge may comprise a lower groove 9 below the tongue 3. The lower lip 42 may be configured to be inserted into the lower groove 9 during the vertical displacement.

The assembling may comprise a displacement in the horizontal direction.

The firs edge and the second edge may be short edges of the first and the second panel.

The assembling may also comprise an angling motion along a long side of the first and or the second panel.

Figure 3A:
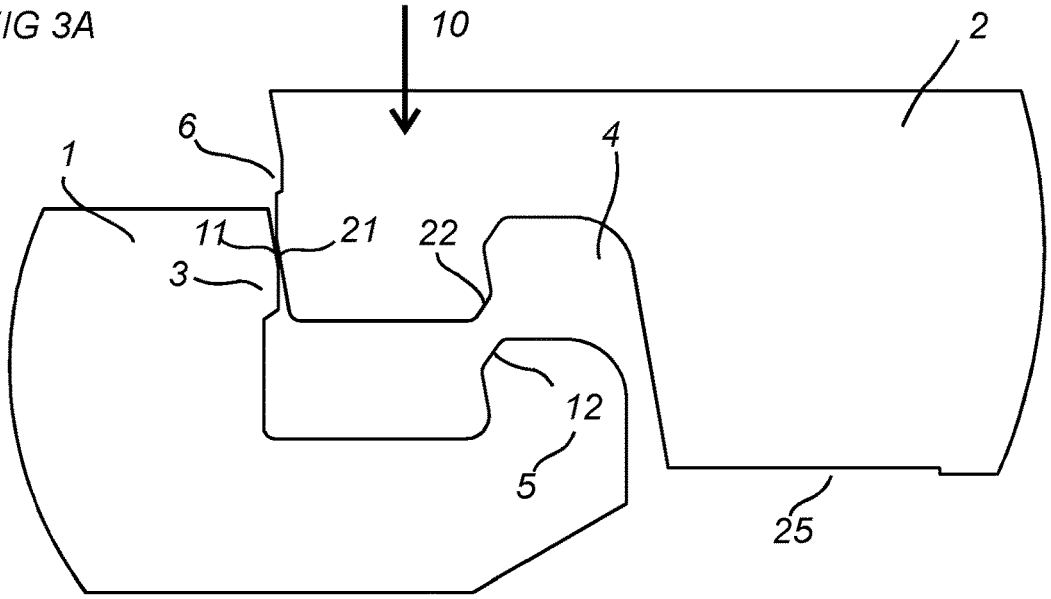
FIGS. 3A-3C show an embodiment of an assembling of an embodiment of a set of panels according to the invention.
Figure 3B:
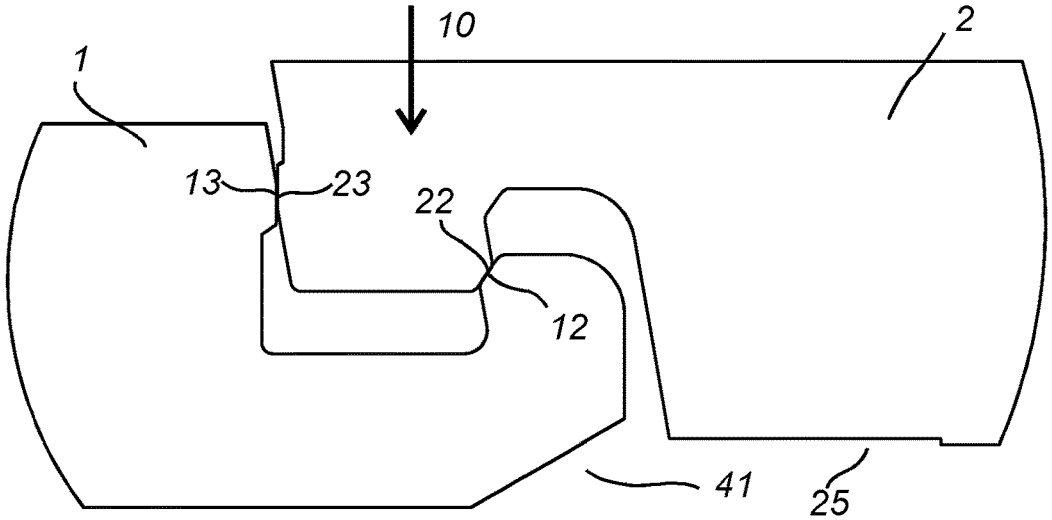
Figure 3C:
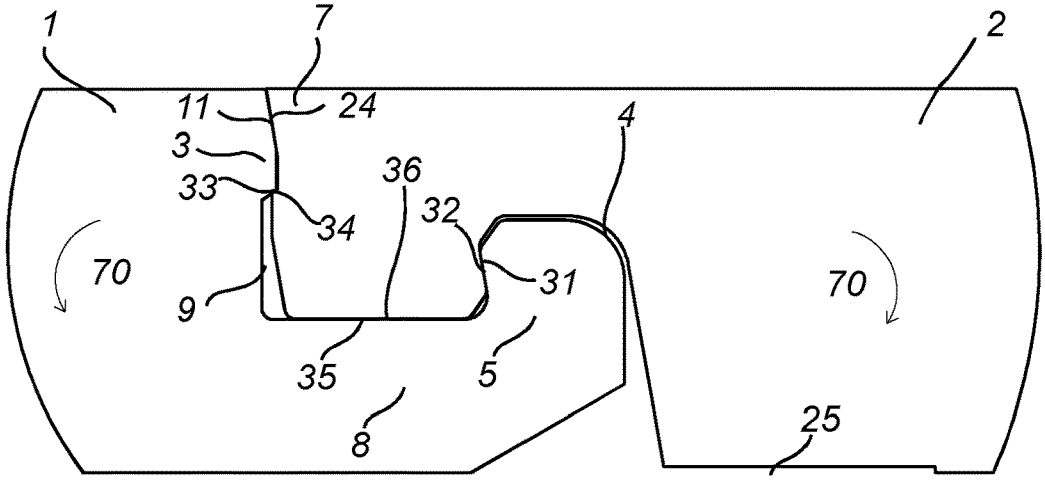

An embodiment of the set of panels is shown during assembling in FIG. 3A-3C. The third and the fourth guiding surfaces 12, 22 are in this embodiment bevels comprising an essentially flat surface. This embodiment may be advantageous for thicker panels and/or panels comprising a wood based core, such as HDF, MDF or plywood. The thicker panels may have a thickness in the range of about 7 mm to about 12 mm.

Figure 5A:
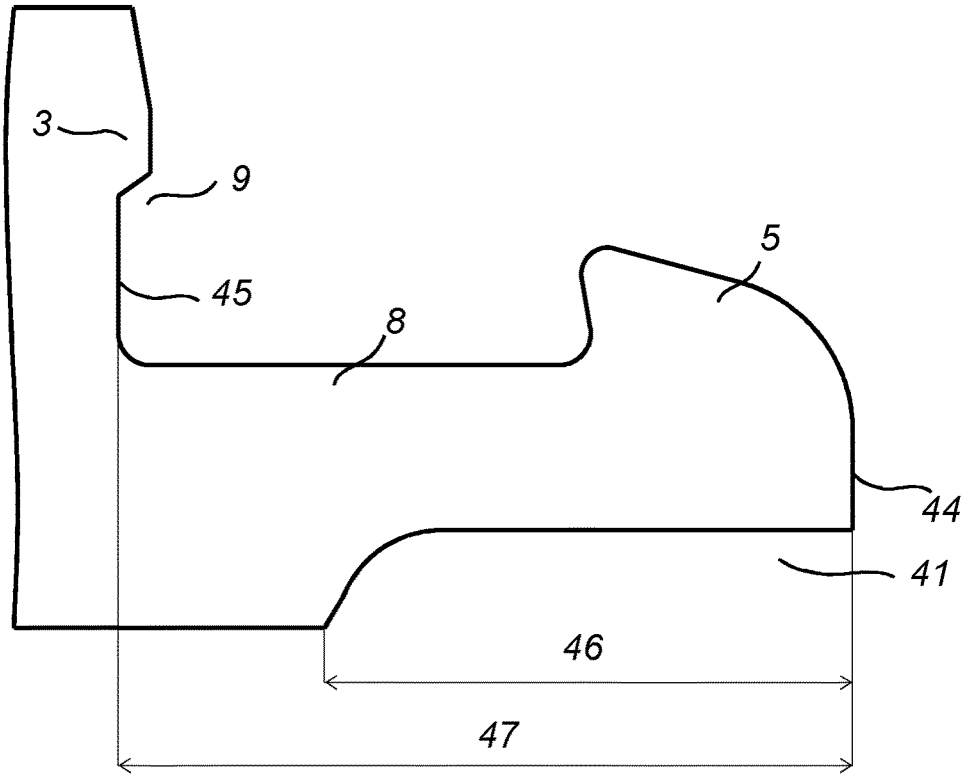
FIGS. 5A-5B show embodiments of an edge of a panel according to an embodiment of the invention.
Figure 5B:
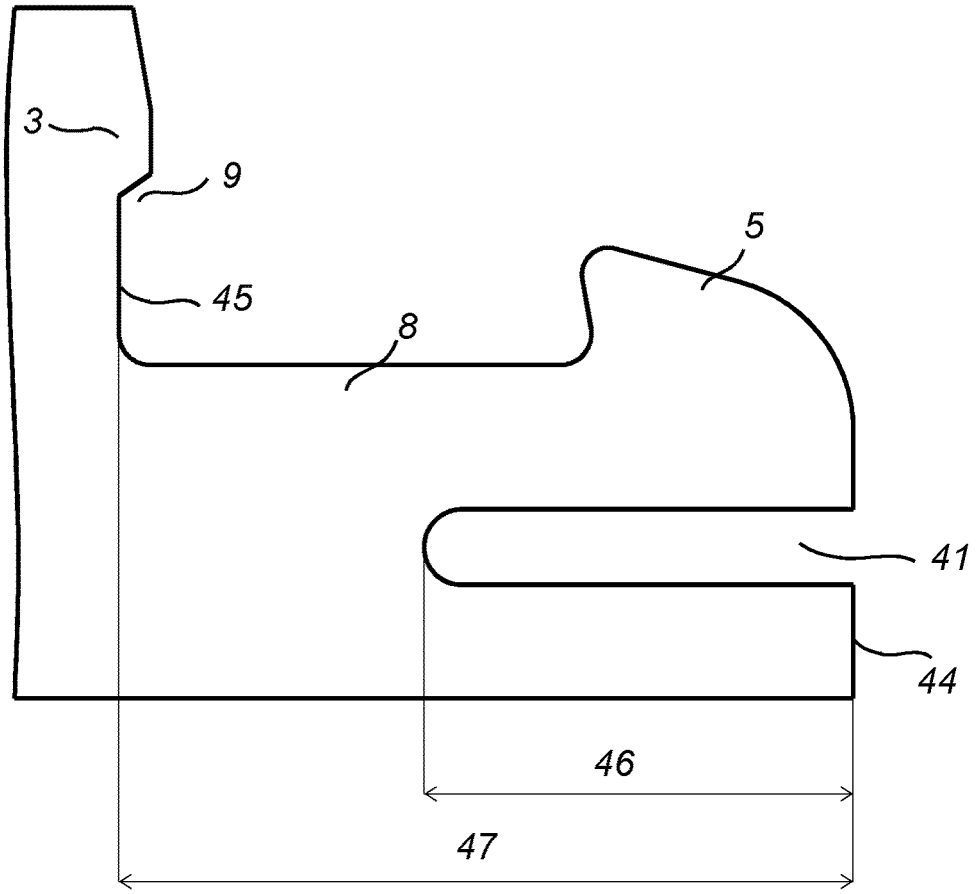

FIG. 5A-5B show embodiments of the first edge comprising a locking strip with a larger space 41. The first edge has a first distance 47 between a bottom surface 45 of the lower groove 9 and an outer surface 44 of the locking strip 8. The space 41 extends from outer surface 44 towards the bottom surface 45 by a second distance 46. The second distance may be within the range of about 1/10 to about equal the first distance, preferably about 1/10 to about 1/2 of the first distance, or more preferably 1/10 to about 1/3 of the first distance. The space 41 may have a height of 0.5 mm to 3 mm, preferably about 1 mm.

The space in the embodiment in FIG. 5A is a recess under the locking strip and the space in FIG. 5B is a groove in the locking strip 8. These embodiments may be advantageous for panels with a larger thickness.

The embodiments described above may be resilient panels. The resilient panels may comprise a core comprising thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The embodiments described above may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The embodiments described above may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

The embodiments described above may comprise a wood base core, such as HDF, MDF or plywood.

Figure 6A:
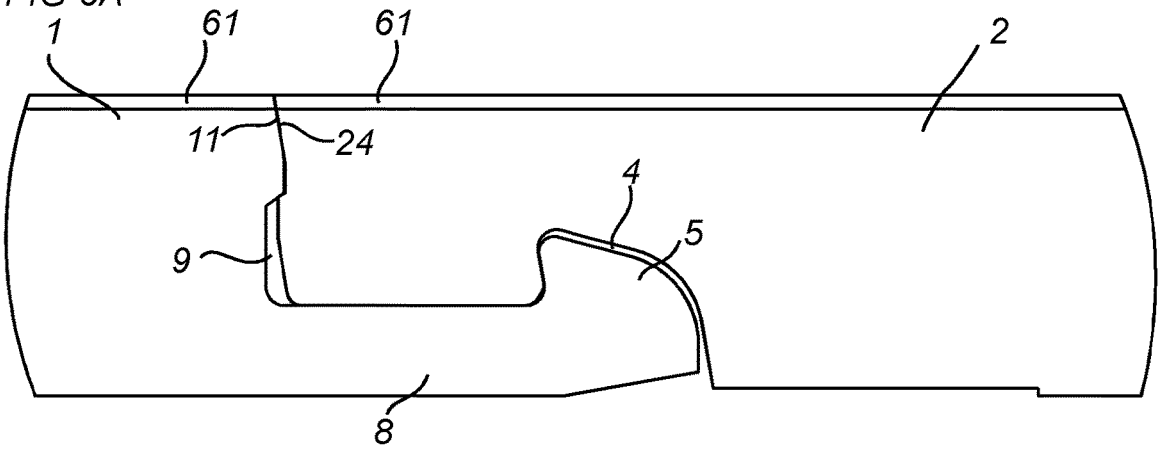
FIGS. 6A-6B show embodiments of a set of panels according to embodiments of the invention.

FIG. 6A shows that the first panel and the second panel may each comprise an upper layer 61, such as a decorative layer and/or wear layer. The first guiding surface 11 preferably extends through the upper layer 61 and a part of the first guiding surface comprises material of the core.

Figure 6B:
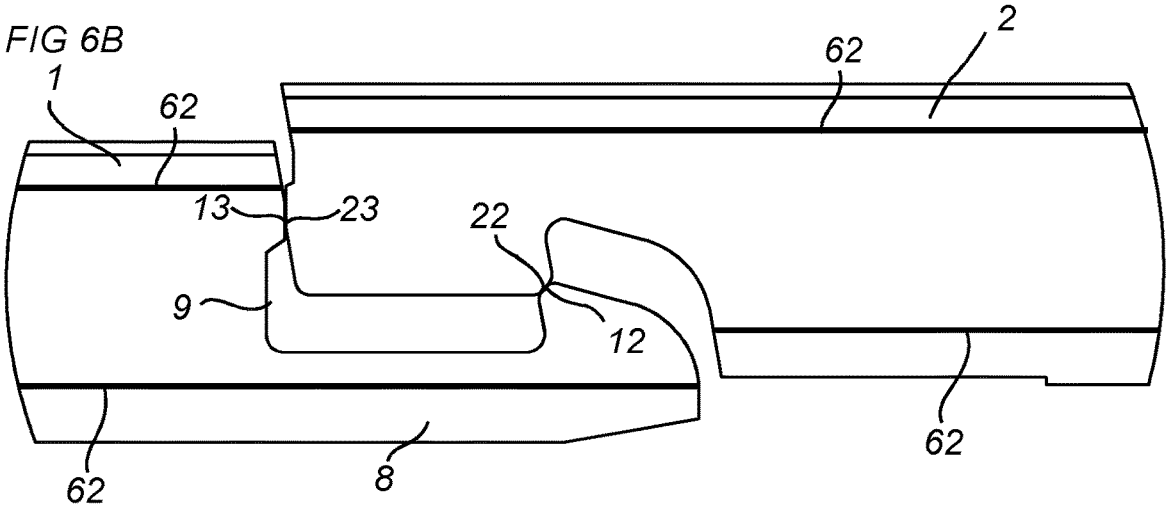

FIG. 6B shows that the first panel and the second panel may each comprise one or more enforcement layers 62 comprising, e.g., glass fiber. The enforcement layers 62 are preferably positioned outside the third and the fourth guiding surfaces 12, 22 and fifth and the sixth guiding surfaces 13,23. Enforcement layers at these guiding surfaces may increase the friction forces during assembling of the first panel and the second panel.

FIG. 7A shows that the second edge of the second panel 2 may comprise a second groove 71 adjacent the second locking surface 32. This groove 71 may facilitate disassembling by downwardly rotating 70 the first and/or the second panel FIG. 7B shows that the first edge of the first panel 2 may comprise a first groove 72 adjacent the first locking surface 31. This groove 72 may facilitate disassembling by downwardly rotating 70 the first and/or the second panel The first edge with the first groove 72 may be combined with the second edge with the second groove 71.

Figure 8A:
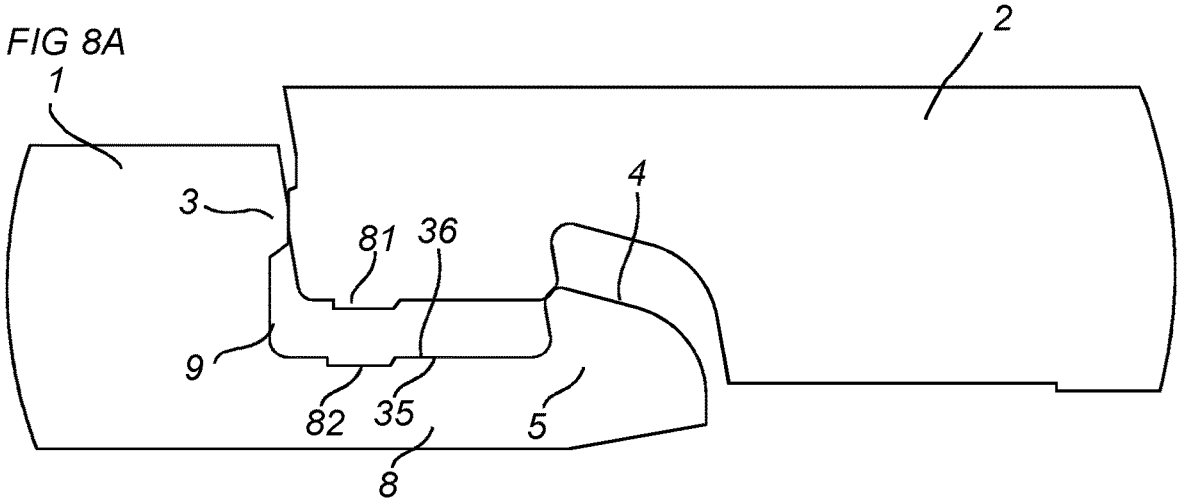
FIGS. 8A-8C show an embodiment of a set of panels according to an embodiment of the invention.
Figure 8B:
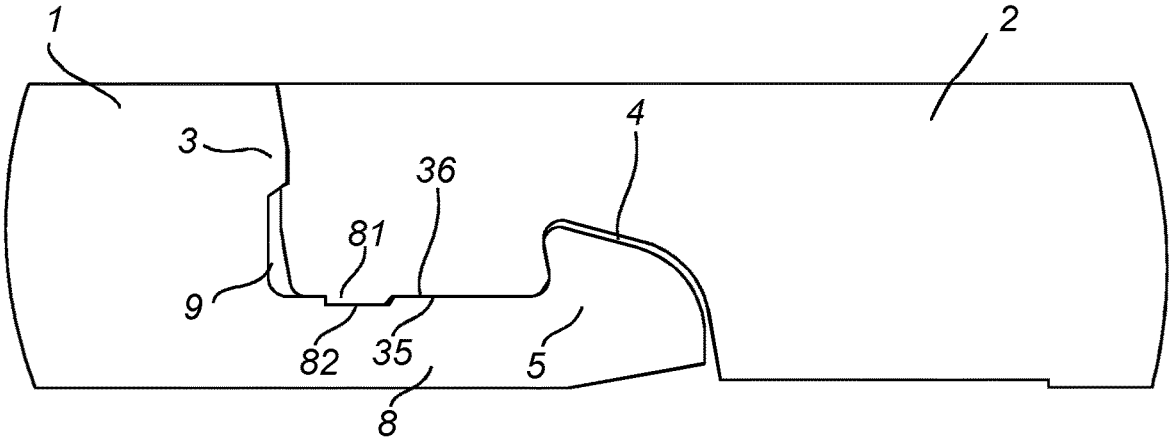
Figure 8C:
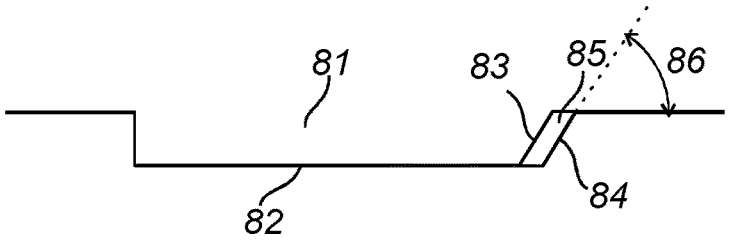

An embodiment of the first edge and the second edge is shown in FIG. 8A-8B. The embodiment includes a locking strip 8 which comprises a notch 82, adjacent the lower groove 9, which is configured to cooperate with a protrusion 81 at lower surface of the second edge and adjacent the lower lip. An advantage with the notch 82 and the protrusion 81 may be that the horizontal strength is further increased.

The notch 82 may comprise a notch surface 84 which may configured to cooperate for locking in the horizontal direction with a protrusion surface 83 of the protrusion 81. The notch surface 84 and the protrusion surface 83 are preferably parallel and arranged at angle 86 which is within the range of about 45° to about 90° to the upper surface of the first panel 1

The notch surface and the protrusion surface may be configured to be positioned at a distance 85 from each other, such as about 0.01 mm to about 0.1 mm, or about 0.05 mm, in the locked position. An advantage with the distance may be that assembling of the first panel and the second panel is facilitated.

In a further embodiment (not shown) the locking strip comprises the protrusion and the lower surface of the second edge comprises the notch.

The invention claimed is:

1. A set of panels comprising a first panel and a second panel, wherein a first edge of the first panel and a second edge of the second panel are configured to be locked together and assembled by a vertical displacement of the second edge relative the first edge, wherein the first edge comprises a locking element configured to cooperate with a locking groove at the second edge for locking in a horizontal direction and in a vertical direction, wherein the first edge comprises a tongue configured to cooperate with a tongue groove at the second edge for locking in the vertical direction, wherein the tongue groove has an upper lip and a lower lip, wherein an upper part of the first edge comprises a first guiding surface and a lower edge of the lower lip comprises a second guiding surface, which are configured to cooperate during the vertical displacement, wherein an upper part of the locking element comprises a third guiding surface and a lower edge of the locking groove comprises a fourth guiding surface, which are configured to cooperate during the vertical displacement, wherein a tip of the tongue comprises a fifth guiding surface and a tip of a lower lip of the tongue groove comprises a sixth guiding surface, which are configured to cooperate during the vertical displacement, wherein the first guiding surface is a bevel or a rounding of an uppermost part of the first edge, which is adjacent to an upper surface of the first panel, and wherein a part of the first guiding surface comprises material of a core of the first panel.

2. The set of panels as claimed in claim 1, wherein the first guiding surface extends through a decorative layer and/or a wear layer.

3. The set of panels as claimed in claim 1, wherein the third and fourth guiding surfaces and fifth and sixth guiding surfaces, respectively, are configured to cooperate at the same time during the vertical displacement.

4. The set of panels as claimed in claim 1, wherein the first and second guiding surfaces are configured to cooperate before the third and fourth guiding surfaces are configured to cooperate during the vertical displacement.

5. The set of panels as claimed in claim 1, wherein the fifth and sixth guiding surfaces are essentially parallel to each other.

6. The set of panels as claimed in claim 1, wherein the first guiding surface is positioned above the fifth guiding surface.

7. The set of panels as claimed in claim 1, wherein the second guiding surface is positioned below the sixth guiding surface.

8. The set of panels as claimed in claim 1, wherein an upper lip of the tongue groove is configured to overlap the first guiding surface in a locked position of the first and second edges.

9. The set of panels as claimed in claim 8, wherein a lower surface of the upper lip is configured to cooperate with the first guiding surface for restraining penetration of moisture and/or dirt between the first and second edges in the locked position.

10. The set of panels as claimed in claim 1, wherein the first guiding surface is adjacent the fifth guiding surface.

11. The set of panels as claimed in claim 1, wherein a locking strip protrudes from the first edge under the tongue, wherein the locking strip comprises the locking element.

12. The set of panels as claimed in claim 11, wherein a first locking surface of the locking element is configured to cooperate with a second locking surface of the locking groove for locking in the vertical direction and the horizontal direction, wherein a first locking angle between the first locking surface and an upper surface of the first panel is within the range of about 45 degrees to about 85 degrees.

13. The set of panels as claimed in claim 1, wherein the tip of the tongue has a blunt shape, wherein each angle between adjacent surfaces at the tip of the tongue is more than 90 degrees.

14. The set of panels as claimed in claim 1, wherein the tip of the lower lip of the tongue groove has a blunt shape, wherein each angle between adjacent surfaces at the tip of the lip is more than 90 degrees.

15. The set of panels as claimed in claim 1, wherein the tongue comprises a locking surface at a lower side, wherein a second tongue angle between the fifth guiding surface and the locking surface of the tongue is in a range of about 100 degrees to about 145 degrees.

16. The set of panels as claimed in claim 1, wherein the tongue groove comprises a locking surface at an upper side of the lower lip, wherein a first lip angle between the locking surface of the lower lip and the sixth guiding surface is in a range of about 100 degrees to about 145 degrees.

* * * * *